US012543836B2

(12) United States Patent
Cenit

(10) Patent No.: US 12,543,836 B2
(45) Date of Patent: Feb. 10, 2026

(54) HAIR WASHING APPARATUSES

(71) Applicant: Luisito Cenit, Wilsonville, OR (US)

(72) Inventor: Luisito Cenit, Wilsonville, OR (US)

( * ) Notice: Subject to any disclaimer, the term of this patent is extended or adjusted under 35 U.S.C. 154(b) by 93 days.

(21) Appl. No.: 18/774,732

(22) Filed: Jul. 16, 2024

(65) Prior Publication Data

US 2026/0020656 A1 Jan. 22, 2026

(51) Int. Cl.
*A45D 19/14* (2006.01)

(52) U.S. Cl.
CPC ..... *A45D 19/14* (2013.01)

(58) Field of Classification Search
CPC ..... A45D 19/14
USPC ..... 4/518, 515, 520, 517, 656, 658, 535; 248/200, 511, 127; 2/174
See application file for complete search history.

(56) References Cited

U.S. PATENT DOCUMENTS 1,112,262 A * 9/1914 Cawley ..... A45D 20/02 34/96
2,850,742 A * 9/1958 Glintz ..... A45D 19/00 312/228
2,914,066 A * 11/1959 Gow ..... A61H 7/006 601/166
3,177,868 A * 4/1965 Wallace ..... A61H 23/04 D28/20
3,456,655 A * 7/1969 Hale ..... A45D 19/14 132/212
3,575,181 A * 4/1971 Rudd ..... A45D 20/22 4/518
3,701,475 A * 10/1972 Neale ..... A45D 19/14 4/DIG. 9
3,752,399 A * 8/1973 Neale ..... A45D 19/14 4/518
3,882,864 A * 5/1975 Montgomery ..... A61M 3/025 601/161
3,996,946 A * 12/1976 Craig ..... A45D 19/10 132/212
4,361,158 A * 11/1982 Baker ..... A45D 19/00 132/212
4,769,861 A * 9/1988 Chang ..... A45D 19/14 4/518

(Continued)

FOREIGN PATENT DOCUMENTS

CN 1108123 C * 5/2003 ..... A45D 19/14
CN 109009800 A * 12/2008 ..... A61G 9/00

(Continued)

*Primary Examiner* — Lori L Baker
(74) *Attorney, Agent, or Firm* — Mohr Intellectual Property Law Solutions, PC

(57) ABSTRACT

Hair washing apparatuses including a sleeve, a cover, a fluid port member, and a seal member. The sleeve is selectively disposed over a head of a user. The sleeve defines a top opening, a bottom opening, and an interior. The top opening is disposed proximate a crown of the head. The bottom opening is opposite the top opening and proximate a temple of the head. The interior is configured to contain a volume of liquid around the head. The cover is selectively coupled to the top opening of the sleeve and is disposed proximate the crown of the head. The fluid port member is in fluid communication with the interior of the sleeve and includes an inlet port and an outlet port. The seal member is disposed around the bottom opening and is configured to form a liquid-tight seal between the sleeve and the head.

20 Claims, 4 Drawing Sheets

(56) References Cited

U.S. PATENT DOCUMENTS

| | | | | | |
|---|---|---|---|---|---|
| 4,834,121 | A * | 5/1989 | Bell | A45D 19/00 | 134/180 |
| 5,146,629 | A * | 9/1992 | Bames | A45D 44/12 | 2/50 |
| 5,551,088 | A * | 9/1996 | Stepp | A45D 44/12 | 4/521 |
| 6,519,777 | B1 * | 2/2003 | Speelman | A45D 44/08 | 4/521 |
| 6,728,977 | B1 * | 5/2004 | Knight | A45D 19/14 | 4/518 |
| 2007/0044225 | A1 * | 3/2007 | Palacios | A45D 19/04 | 4/516 |
| 2007/0108640 | A1 * | 5/2007 | Takahashi | B01F 25/45 | 261/76 |

FOREIGN PATENT DOCUMENTS

| | | | | | |
|---|---|---|---|---|---|
| CN | 102210511 | A | * | 10/2011 | A45D 19/18 |
| CN | 202932266 | U | * | 5/2013 | A45D 19/00 |
| CN | 106175020 | A | * | 12/2016 | A45D 19/14 |
| CN | 107212561 | A | * | 9/2017 | A61H 7/00 |
| CN | 107224079 | A | * | 10/2017 | A45D 19/005 |
| CN | 105962606 | B | * | 5/2018 | A45D 19/14 |
| CN | 109527760 | A | * | 3/2019 | A61H 23/04 |
| CN | 108887850 | A | * | 11/2019 | A45D 19/00 |
| CN | 110840047 | A | * | 2/2020 | A61H 7/007 |
| CN | 110916322 | A | * | 3/2020 | A45D 19/14 |
| CN | 111528602 | A | * | 8/2020 | A45D 19/005 |
| CN | 111838933 | A | * | 10/2020 | A45D 19/14 |
| CN | 112998377 | A | * | 6/2021 | A61H 23/02 |
| CN | 113197409 | A | * | 8/2021 | A45D 19/14 |
| CN | 115005580 | A | * | 9/2022 | A45D 19/00 |
| CN | 217565181 | U | * | 10/2022 | A45D 19/00 |
| CN | 115316771 | A | * | 11/2022 | A45D 20/14 |
| CN | 106175020 | B | * | 6/2023 | A45D 19/10 |
| CN | 116549246 | A | * | 8/2023 | A61G 12/001 |
| CN | 116649699 | A | * | 8/2023 | A45D 19/14 |
| CN | 119302814 | A | * | 1/2025 | F26B 21/004 |
| CN | 119344548 | A | * | 1/2025 | A61H 7/007 |
| EP | 1430805 | A1 | * | 6/2004 | A45D 19/14 |
| JP | H0646917 | A | * | 2/1994 | A45D 19/00 |
| JP | H0898714 | A | * | 4/1996 | A45D 19/00 |
| JP | 2001149133 | A | * | 6/2001 | A45D 19/00 |
| JP | 2002051928 | A | * | 2/2002 | A45D 19/00 |
| JP | 2006263110 | A | * | 10/2006 | A45D 19/00 |
| JP | 4289748 | B2 | * | 7/2009 | A45D 19/00 |
| JP | 2015019669 | A | * | 2/2015 | A45D 19/00 |
| JP | 6041973 | B1 | * | 12/2016 | A45D 19/06 |
| JP | 2017119040 | A | * | 7/2017 | A45D 19/10 |
| JP | 7614692 | B1 | * | 1/2025 | A45D 19/14 |
| KR | 100662658 | B1 | * | 12/2006 | A45D 19/18 |
| KR | 100837441 | B1 | * | 6/2008 | A45D 19/04 |
| KR | 102416053 | B1 | * | 7/2022 | A45D 19/14 |
| KR | 102460029 | B1 | * | 10/2022 | A45D 19/04 |
| WO | WO-2005029998 | A1 | * | 4/2005 | A45D 19/02 |
| WO | WO-2006008794 | A1 | * | 1/2006 | A45D 19/14 |
| WO | WO-2008002998 | A2 | * | 1/2008 | E03B 11/02 |
| WO | WO-2012023278 | A1 | * | 2/2012 | A45D 19/02 |

* cited by examiner

HAIR WASHING APPARATUSES

BACKGROUND

The present disclosure relates generally to solutions for washing a person's hair. In particular, hair washing apparatuses are described.

Hair washing is known to be essential for maintaining good hygiene. For most people, washing one's hair is a simple undertaking a person can do himself or herself. For people with disabilities, washing one's hair may be difficult or impossible. Further, people with limited mobility or otherwise in need of a caretaker may rely on others to wash their hair.

Hospital and caretaking facilities are common settings where medical personnel or caretakers are tasked with washing hair of individuals who can not assist much in the hair washing undertaking. Home care also often involves washing the hair of someone unable to assist by positioning themselves near a sink or drain.

Washing another person's hair through conventional means can be a challenge when the person is not able to move or support his or her head over a sink or drain. Moving a person to a sink may be impractical or difficult. Washing another person's hair without a sink to collect and drain away wash and rinse water creates a mess and hazardously slippery conditions. Attempting to collect hair washing water in a container is tedious and laborious.

It would be desirable to have a hair washing solution that was effective and convenient to use with people who need hair washing assistance. There would be benefits to a hair washing solution that avoided water messes and hassles without requiring a person to be near a sink. It would be advantageous if there was a hair washing solution that did not require a person to move from a bed, such as people in comas, people in vegetative states, or people who are bedridden.

It would be beneficial to have a hair washing solution that allowed for agitating soap and water into a person's hair without the caretaker's hands getting wet. There would be appeal to a hair washing solution that allowed for easily delivering water, shampoo, and conditioner to a person's hair. It would be desirable to have a hair washing solution that allowed a caretaker to know how much water was delivered for washing and rinsing. There would further be advantages to a hair washing solution that enabled easily draining away wash and rinse water.

Thus, there exists a need for hair washing apparatuses that improve upon and advance the design of known hair washing solutions. Examples of new and useful hair washing apparatuses relevant to the needs existing in the field are discussed below.

SUMMARY

The present disclosure is directed to hair washing apparatuses including a sleeve, a cover, a fluid port member, and a seal member. The sleeve is selectively disposed over a head of a user. The sleeve defines a top opening, a bottom opening, and an interior. The top opening is disposed proximate a crown of the head. The bottom opening is opposite the top opening and proximate a temple of the head. The interior is configured to contain a volume of liquid around the head. The cover is selectively coupled to the top opening of the sleeve and is disposed proximate the crown of the head. The fluid port member is in fluid communication with the interior of the sleeve and includes an inlet port and an outlet port. The seal member is disposed around the bottom opening of the sleeve and is configured to form a liquid-tight seal between the sleeve and the head.

DETAILED DESCRIPTION

Figure 1:
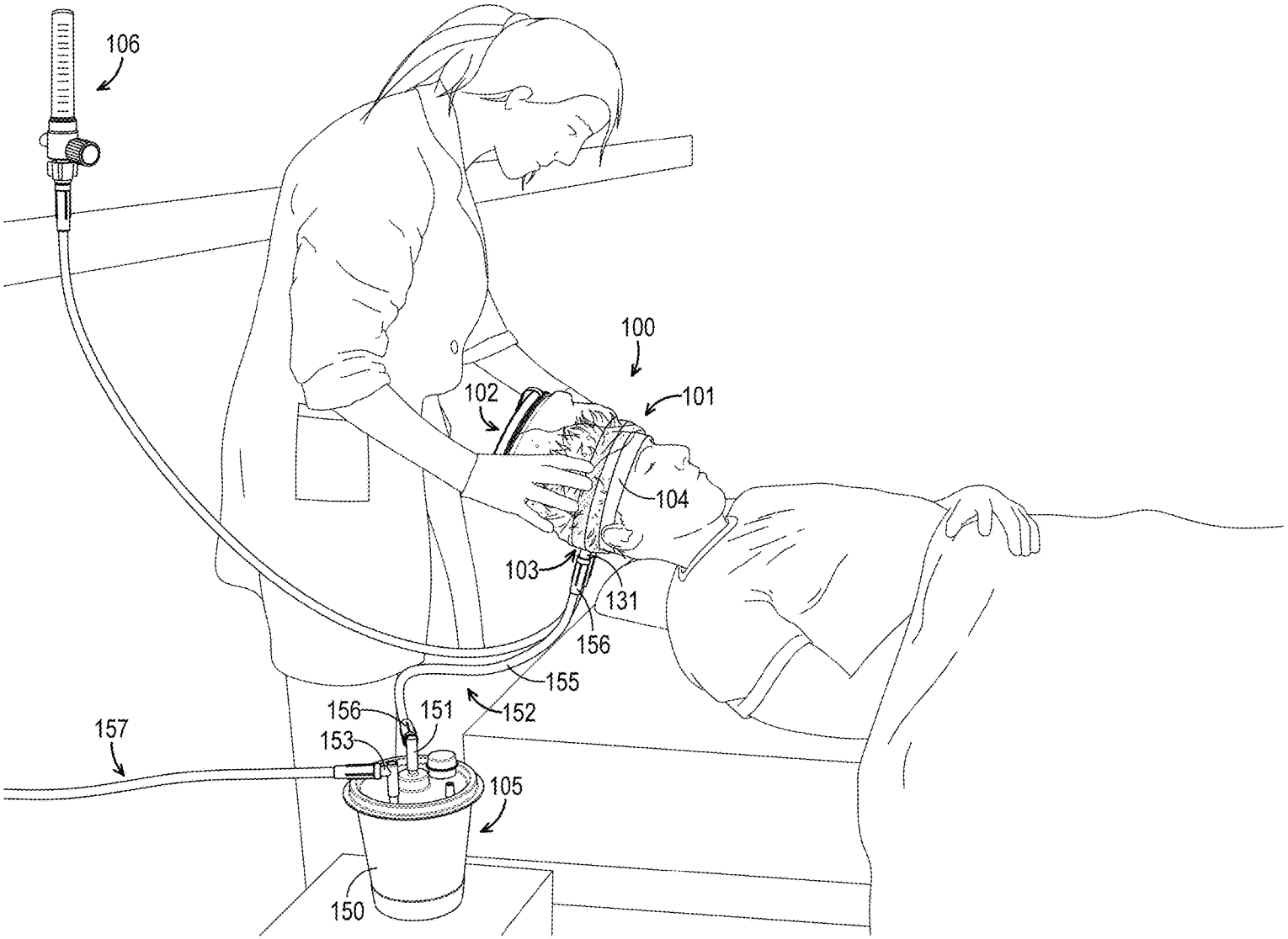
FIG. 1 is a perspective view of a first example of a hair washing apparatus worn on a head of a person lying in a bed and massaged against the head of the person with hands of a caregiver.

The disclosed hair washing apparatuses will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various hair washing apparatuses are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

DEFINITIONS

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Hair Washing Apparatuses

With reference to the figures, hair washing apparatuses will now be described. The hair washing apparatuses discussed herein enable washing another person's hair without assistance from the person whose hair is being washed.

The reader will appreciate from the figures and description below that the presently disclosed hair washing apparatuses address many of the shortcomings of conventional hair washing apparatuses. For example, the novel hair washing apparatuses are effective and convenient to use with people who need hair washing assistance. Beneficially, the novel hair washing apparatuses avoid water messes and hassles without requiring a person to be near a sink. Helpfully, the novel hair washing apparatuses facilitate removing dandruff, lice, and other impurities from the hair of a user.

Advantageously, the novel hair washing apparatuses do not require people to move from a bed to have their hair washed. As a result, the novel hair washing apparatuses are well suited for washing the hair of people in comas, people in vegetative states, or people who are bedridden.

Beneficially, the novel hair washing apparatuses allow for agitating water and soap and/or conditioner into a person's hair without the caretaker's hands getting wet. One appeal of the novel hair washing apparatuses is that they allow for easily delivering water, shampoo, and conditioner to a person's hair. Desirably, the novel hair washing apparatuses allow a caretaker to know how much water was delivered for washing and rinsing. A further advantage of the novel hair washing apparatuses is that they enable easily draining away wash and rinse water.

Hair Washing Apparatus Embodiment One

With reference to FIGS. 1-4, a first example of a hair washing apparatus, hair washing apparatus 100, will now be described. Hair washing apparatus 100 includes a sleeve 101, a cover 102, a fluid port member 103, a seal member 104, a discard system 105, and a gas supply 106. The components of hair washing apparatus 100 are described further below.

In some examples, the hair washing apparatus does not include one or more features included in hair washing apparatus 100. For instance, some hair washing apparatus examples do not include a discard system or a gas supply. In other examples, the hair washing apparatus includes additional or alternative features than depicted in the figures.

The size and shape of the hair washing apparatus may be different than depicted in the figures in different examples. For example, the hair washing apparatus may be larger or smaller than shown. Additionally or alternatively, the hair washing apparatus may be a variety of different shapes.

Sleeve

Sleeve 101 functions to contain a volume of liquid, such as water, cleaning solutions, and conditioning solutions, around a head of a person whose hair is being washed. As depicted in FIG. 1, sleeve 101 also serves to enable wash and/or conditioning solutions to be agitated into a person's hair and scalp by a caregiver or other person assisting with hair washing. Sleeve 101 also guides the hair washer to know the amount of liquid contained within the sleeve for measurement purposes.

With reference to FIG. 1, the reader can see that sleeve 101 is configured to be selectively disposed over a head of a user. In this context, user refers to the person whose hair is being washed with hair washing apparatus 100 rather than the person washing the other person's hair. For simplicity, the term user will be used to refer to the person whose hair is being washed with hair washing apparatus 100 and the term caregiver will be used to refer to the person using hair washing apparatus 100 to wash the user's hair.

The reader should understand that the term caregiver is intended to be broadly construed. In some examples, caregivers are people caring for elderly or disabled people. Similarly, a caregiver may be a nurse or other medical professional. As used in this document, a caregiver may further be a spouse, partner, or parent. Further, the term caregiver is also intended to include hair professionals at hair salons and barbershops. Caregivers may utilize the hair washing apparatus in hospital, home, and nursing home settings among a variety of other places.

Sleeve 101 and hair washing apparatus 100 as a whole is designed to be easily installed on a user's head by a caregiver with little or no assistance from the user. The user need not get out of bed or support his or her head over a sink to have sleeve 101 placed around the user's head. Instead, sleeve 101 is configured to enable a caregiver to place sleeve 101 over a user's head however the user is oriented and with whatever level of assistance the user can provide.

The size and shape of the sleeve may vary in different examples. For example, larger and smaller sleeves may be selected to accommodate people with larger and smaller heads, respectively. For instance, a sleeve appropriate for an adult may be larger than ideal for a child. However, in most instances the size and shape of the sleeve will work effectively for most all user head sizes and shapes.

Figure 2:
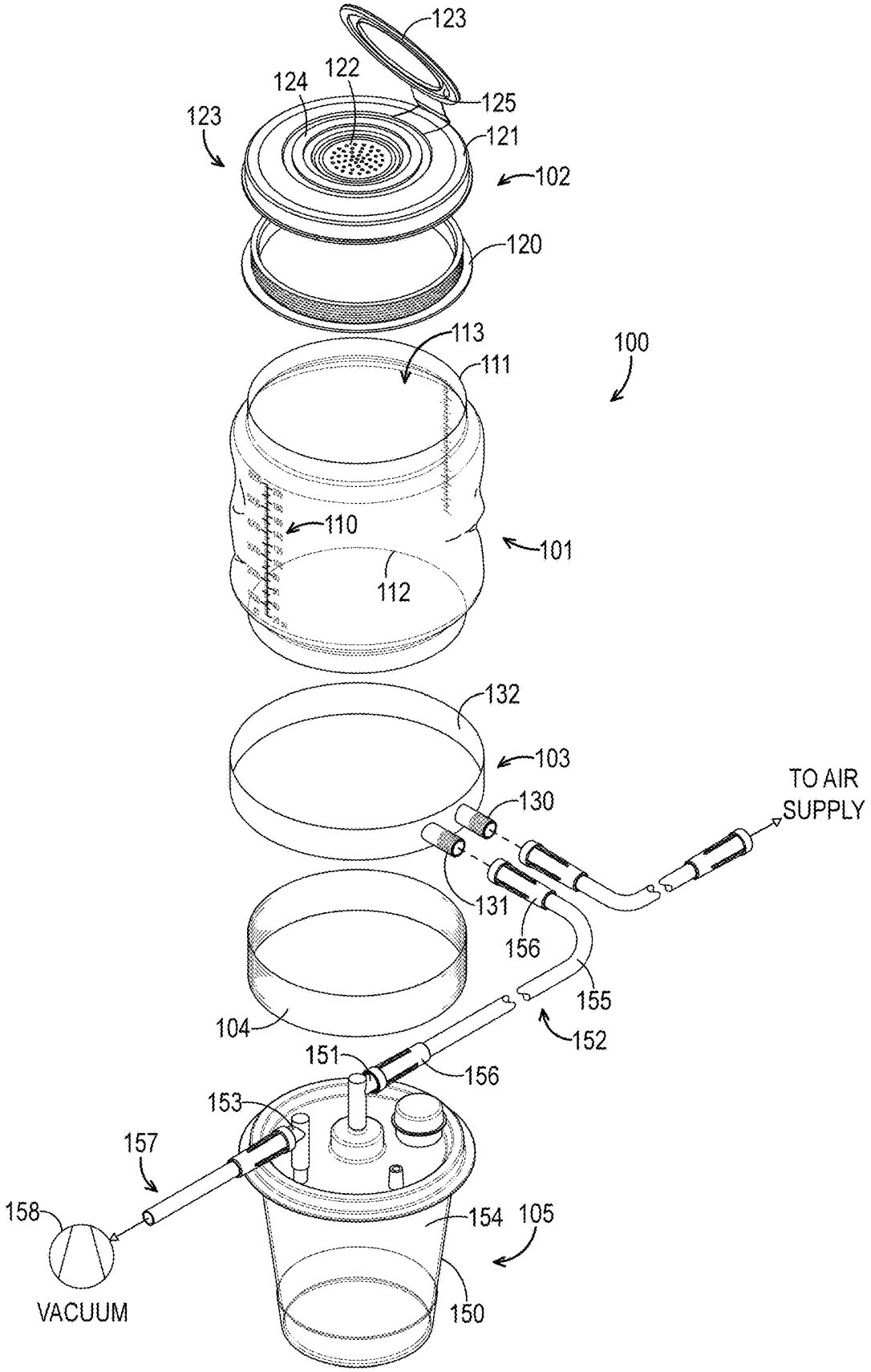
FIG. 2 is an exploded view of the hair washing apparatus shown in FIG. 1.
Figure 3:
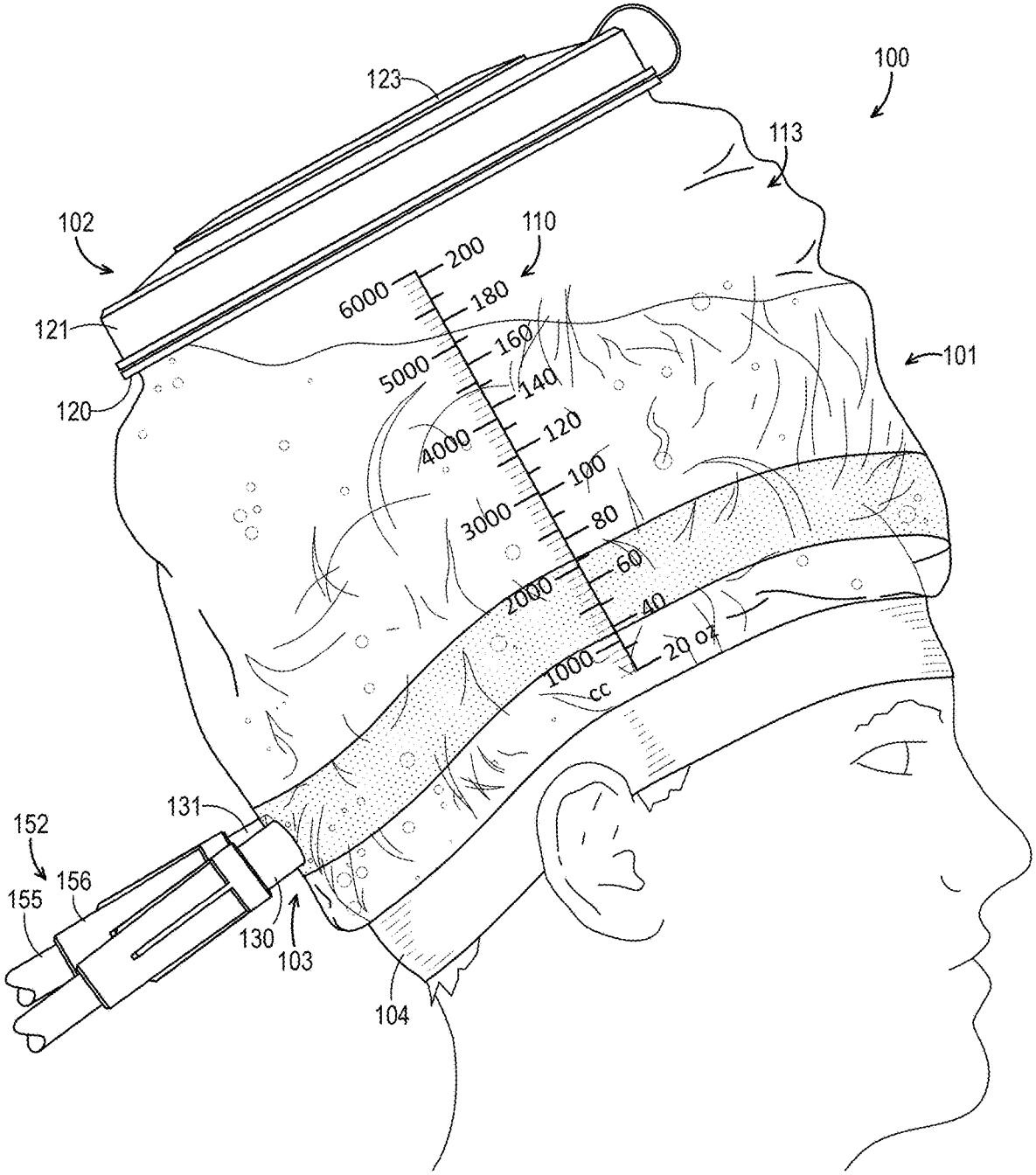
FIG. 3 is a side elevation view of the hair washing apparatus shown in FIG. 1 worn on the person's head with a volume of cleaning solution liquid contained within the sleeve and gas bubbles in the liquid.

As shown in FIGS. 1-3, sleeve 101 is formed from a flexible material. Sleeve 101 being formed from a flexible material enables it to be worked with a caregiver's hands as depicted in FIG. 1. A caregiver working sleeve 101 with his or hands serves to agitate the volume of liquid around the user's head. Agitating the washing and/or conditioning solution disposed between sleeve 101 and the user's head may make washing or conditioning the hair of the user more effective. In some examples, the sleeve is formed from a rigid material and is not configured to be worked by a caregiver's hands.

In the present example, sleeve 101 is formed from a liquid-tight (watertight), flexible, plastic material. The sleeve may be formed from a wide variety of materials suitable for containing water, water-based cleaning and conditioning solutions, or other liquids. The sleeve may be formed from any currently known or later developed material suitable for containing liquids and placing around a person's head.

Figure 4:
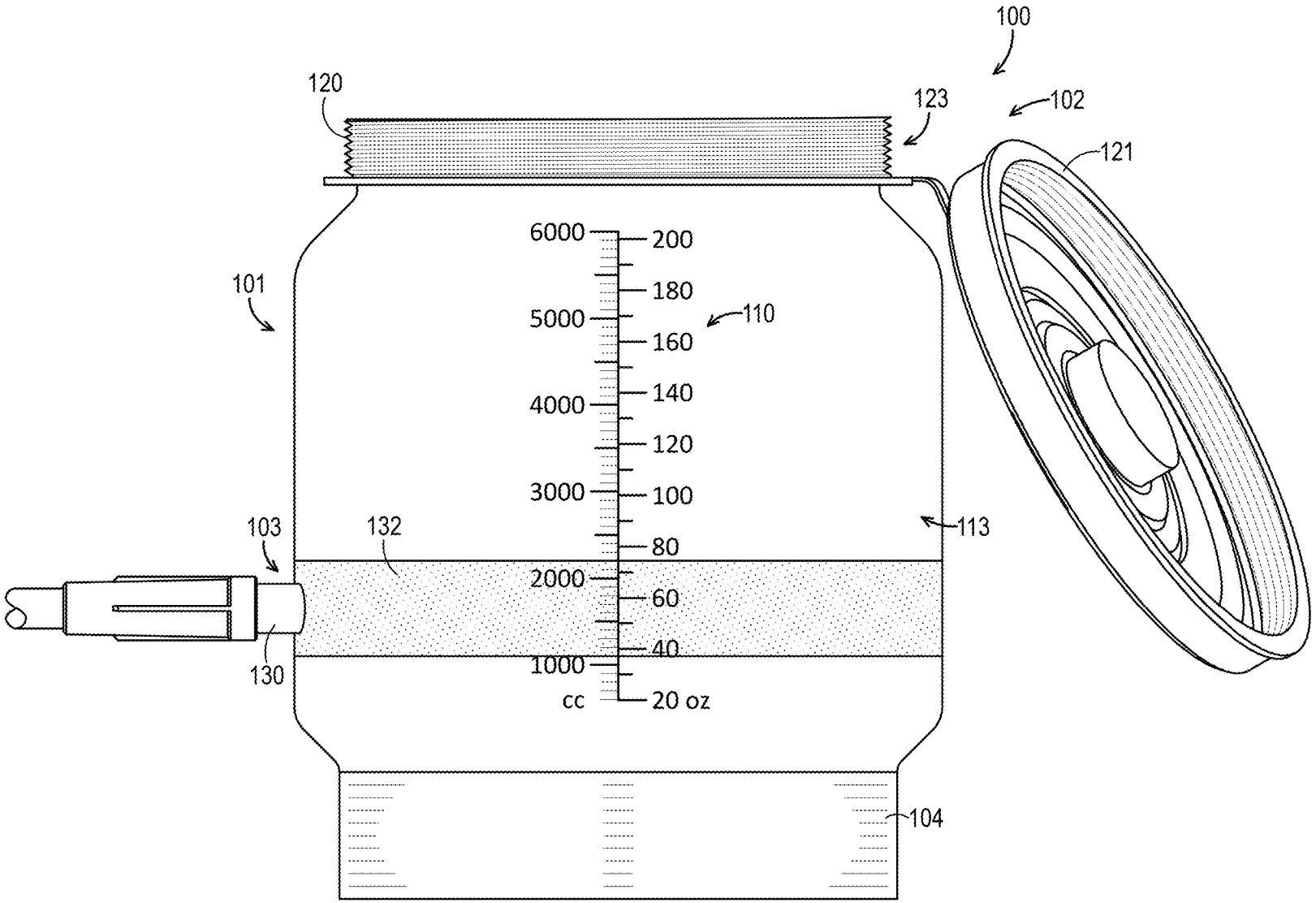
FIG. 4 is a side elevation view of the hair washing apparatus shown in FIG. 1 with a threaded lid separated from a threaded base rim to provide access to the sleeve.

As shown in FIGS. 2-4, sleeve 101 includes graduation markings 110. Graduation markings 110 are configured to indicate the volume of liquid contained in the interior of sleeve 101. Knowing the volume of liquid contained by sleeve 101 assists a caregiver with dosing uniformity. For example, it may be known that 3000 cubic centimeters of cleaning solution is desirable for washing hair and graduation markings 110 enable a caregiver to know when 3000 cubic centimeters of cleaning solution have be added to sleeve 101.

Further, knowing the volume of liquid contained by sleeve 101 assists a caregiver with measurements related to forming cleaning and conditioning solutions. For example, a cleaning solution of X parts water and Y parts shampoo may be effective for hair washing. Graduation markings 110 enable the caregiver to know when the X parts of water have been added to sleeve 101. Y parts shampoo can then be added to the interior of sleeve 101, such as by dispensing shampoo through cover 102.

As shown in FIGS. 2-4, sleeve 101 defines a top opening 111, a bottom opening 112, and an interior 113. As depicted in FIG. 3, top opening 111 is disposed proximate a crown of the user's head. With continued reference to FIG. 3, bottom opening 112 is opposite top opening 111 and proximate a temple of the user's head.

Interior 113 is located between top opening 111 and bottom opening 112. Interior 113 is configured to contain a volume of liquid around the user's head. More broadly, interior 113 is configured to contain a volume of liquid around the user's head, including a washing solution, a conditioning solution, and rinse water.

Interior 113 of sleeve 101 is in fluid communication with fluid port member 103 and cover 102. Interior 113 being in fluid communication with fluid port member 103 enables gas to be introduced into interior 113 via gas supply 106 coupled to an inlet port 130 of fluid port member 103. Interior 113 being in fluid communication with fluid port member 103 also enables soiled liquid and rinse water to be discarded from interior 113 to a discard system 105 through an outlet port 131 of fluid port member 103.

Interior 113 being in fluid communication with cover 102 enables wash and rinse water to be introduced into interior 113 through cover 102. Shampoo and conditioner may also be introduced into interior 113 through cover 102.

Cover

Cover 102 enables water or other liquids, shampoo, conditioner, or other substances (solid or liquid) to be selectively introduced into sleeve 101 through top opening 112. Cover 102 also functions to restrict fluid from exiting sleeve 101 through top opening 112. Cover 102 further enables gas introduced into sleeve 101 through fluid port member 103 to be vented out of sleeve 101 to avoid over-pressurizing sleeve 101 with introduced gas.

As shown in FIGS. 1-4, cover 102 is selectively coupled to top opening 112 of sleeve 101. Cover 102 and sleeve 101 are in fluid communication through top opening 112. With reference to FIG. 3, the reader can see that cover 102 is disposed closer to the crown of the user's head than other parts of the user's head.

As shown in FIG. 2, cover 102 includes a base rim 120 and a lid 121. Base rim 120 is coupled to top opening 112 of sleeve 101. Lid 121 is selectively removable from base rim 120.

As depicted in FIG. 2, base rim 120 and lid 121 define complementary threads. The complementary threads enable base rim 120 and lid 121 to threadingly couple. When selectively coupled together, base rim 120 and lid 121 form a liquid-tight seal. When lid 121 is selectively uncoupled from base rim 120, top opening 112 is accessible through a corresponding opening in base rim 120, which enables water or other liquids, shampoo, conditioner, or other substances to be conveniently added to interior 113 of sleeve 101.

As shown in FIG. 2, cover 102 includes a vent 122. Vent 122 is configured with a plurality of openings in fluid communication with sleeve 101. The plurality of openings of vent 122 enables gas introduced into sleeve 101 through fluid port member 103 by gas supply 106 to exit sleeve 101. Gas exiting sleeve 101 through vent 122 avoids sleeve 101 becoming over-pressurized.

As is apparent from FIGS. 2 and 3, cover 102 is configured to selectively open and close vent 122. In particular, cover 102 includes a cap 123 to selectively open and close vent 122. As shown in FIG. 3, cap 123 may be selectively disposed over vent 122 to selectively close vent 122. Fluid, including liquids and gases, are restricted from passing through vent 122 when cap 123 selectively covers vent 122.

As shown in FIG. 2, cap 123 may be selectively removed from vent 122 to open vent 122. Gas may selectively exit sleeve 101 through vent 122 when cap 123 is selectively removed from vent 122. Further, water or other liquids, shampoo, conditioner, or other substances (liquid or solid, such as powders) may be selectively introduced into sleeve 101 through vent 122 when cap 123 is selectively removed from vent 122; however, introducing water, shampoo, conditioner, or other substances through the opening of base rim 120 when lid 121 is selectively uncoupled from base rim 120 may be more convenient as the opening in base rim 120 may enable fluids to be introduced at a higher flow rate than may be possible through vent 122.

As shown in FIG. 2, cap 123 is complementarily configured with vent 122. The complementary configuration of cap 123 and vent 122 enables cap 123 to selectively couple to vent 122.

In the present example, as depicted in FIG. 2, vent 122 includes a lip 124 extending around an outer periphery of vent 122. With continued reference to FIG. 2, cap 123 defines a cap recess 125 extending around cap 123 and complementarily configured with lip 124. In the example shown in FIGS. 1-4, cap 123 and lip 124 selectively couple via a press fit when lip 124 inserts into cap recess 125. In some examples, the cap and the lip define complementary threads enabling the cap and the lip to threadingly couple.

The size and the shape of the cover may vary in different examples. In some examples, the cover is larger relative to the sleeve and other components than depicted in FIGS. 1-4. In other examples, the cover is smaller relative to the other components. The shape need not be round in all examples. For instance, the cover may be square, rectangular, other regular polygons, or an irregular shape.

In the present example, the cover is formed from a polymer material. However, the cover may be formed from any currently known or later developed material suitable for liquid cover and venting applications.

Fluid Port Member

Fluid port member 103 enables gas to be introduced into sleeve 101 from gas supply 106. Further, fluid port member 103 facilitates removing liquid, such as water and cleaning or conditioning solutions, from sleeve 101 to discard system 105.

As depicted in FIGS. 2 and 3, fluid port member 103 includes inlet port 130, outlet port 131, and a band 132. Inlet port 130 and outlet port 131 are supported on band 132. Band 132 is configured to encircle a user's head inside sleeve 101.

In the present example, inlet port 130 is horizontally adjacent to outlet port 131. However, the ports may be oriented differently in different examples. For example, the inlet port may be above or below the outlet port. In some examples, the inlet port is located on a first side of the sleeve and the outlet port is located on an opposite side of the sleeve. In still further examples, the inlet port is located on a first side of the sleeve and the outlet port is circumferentially offset from the inlet port by 90 degrees or any other angle.

As shown in FIGS. 1-4, fluid port member 103 is in fluid communication with interior 113 of sleeve 101. In particular, inlet port 130 and outlet port 131 extend through openings formed in sleeve 101. In the present example, inlet port 130 and outlet port 131 are pressed through sleeve 101 to pierce sleeve 101 and form the openings through sleeve 101. In other examples, the openings in the sleeve are pre-formed and the inlet and outlet ports pass through the pre-formed openings.

Inlet port 130 and outlet port 131 form liquid-tight seals with sleeve 101 when extending through sleeve 101. A tight tolerance between the ports and the openings formed in sleeve 101 restricts fluid from exiting sleeve 101 around the outside of the ports. In some examples, o-rings or other suitable gaskets are used seal the openings through which the ports extend.

As shown in FIGS. 1-4, inlet port 130 and outlet port 131 are disposed between top opening 111 of sleeve 101 and seal member 104. As is apparent from FIGS. 1-4, inlet port 130 and outlet port 131 are disposed closer to seal member 104 than to top opening 111. More specifically, inlet port 130 and outlet port 131 are spaced from seal member 104 to define a gap between seal member 104 and the ports. The gap between seal member 104 and the ports serves to avoid seal member 104 restricting fluid communication between interior 113 of sleeve 101 and inlet port 130 and outlet port 131.

As shown in FIG. 2, fluid port member 103 is in fluid communication with gas supply 106 and discard system 105. In particular, inlet port 130 is in fluid communication with gas supply 106 and outlet port 131 is in fluid communication with discard system 105. The fluid communication established by fluid port member 103 enables gas to be introduced into interior 113 via gas supply 106 coupled to an inlet port 130. The fluid communication established by fluid port member 103 also enables soiled liquid and rinse water to be discarded from interior 113 to a discard system 105 through outlet port 131.

While fluid port member 103 includes two ports, the fluid port member may include additional or fewer ports in other examples. For example, the fluid port member may include a third port through which water, cleaning solutions, or other liquids may be introduced into the interior of the sleeve. In some examples, the fluid port member includes a single port. Single port examples may intend for the caregiver to selectively couple different fluid lines to the single port. For example, a caregiver may first couple a gas supply line to the port to bubble gas through the sleeve when washing the user's hair and thereafter couple a fluid discard line to the port to remove the soiled cleaning solution.

Seal Member

Seal member 104 functions to seal bottom opening 112 of sleeve 101 around a user's head. As depicted in FIG. 3, sealing bottom opening 112 against a user's head enables sleeve 101 to contain a volume of liquid in interior 113 against the user's head and hair. As shown in FIG. 1, the volume of liquid, such as a cleaning or conditioning solution, can be agitated into the user's hair.

With reference to FIGS. 1 and 3, the reader can see that seal member 104 is disposed around bottom opening 112 of sleeve 101. Seal member 104 is configured to form a liquid-tight seal between sleeve 101 and the user's head. The liquid-tight seal formed by seal member 104 serves to contain a volume of liquid in interior 113 until the liquid is selectively removed through outlet port 131 of fluid port member 103.

As shown in FIGS. 3 and 4, seal member 104 is disposed below inlet port 130 and outlet port 131 opposite top opening 111. Seal member 104 is spaced from inlet port 130 and outlet port 131 to define a gap between seal member 104 and the ports. The gap between seal member 104 and the ports serves to avoid seal member 104 restricting fluid communication between interior 113 of sleeve 101 and inlet port 130 and outlet port 131.

In the present example, seal member 104 is an elastic band with a relaxed size selected to be smaller than an outer size of a user's head. Seal member 104 is stretched to fit around the user's head and then allowed to elastically retract to a smaller size around sleeve 101 proximate bottom opening 112 to seal sleeve 101 against the user's head. When seal member 104 elastically retracts after stretching force is removed, seal member 104 presses sleeve 101 against the user's head with sufficient force to form a liquid-tight seal.

In the present example, seal member 104 is formed from rubber as a band. However, the seal member may be formed from any currently known or later developed material suitable for forming liquid seals. Further, the seal member may be configured as an O-ring or other type of seal or gasket beyond bands.

Discard System

Discard system 105 is configured to selectively remove liquid from interior 113 of sleeve 101 through outlet port 131 of fluid port member 103. As a result, discard system 105 provides a convenient and clean way to discard liquids, such as water, cleaning solutions, and conditioning solutions, used to wash and/or condition the user's hair without requiring the user to support his or her head over a sink or drain.

As shown in FIGS. 1-3, discard system 105 is selectively coupled to fluid port member 103. In particular, discard system 105 is selectively coupled to outlet port 131 of fluid port member 103. Selective coupling is accomplished via a fluid coupler 156 of a canister inlet line 152 of discard system 105 mounting over outlet port 131.

With reference to FIGS. 1 and 2, discard system 105 includes a canister 150, a canister inlet port 151, a canister inlet line 152, and a vacuum port 153. As shown in FIG. 2, canister 150 defines a canister interior volume 154. Canister interior volume 154 functions to collect soiled liquid discarded from sleeve 101 through fluid port member 103.

Canister inlet port 151 is in fluid communication with canister interior volume 154 and with canister inlet line 152. Canister inlet line 152 is configured to selectively couple to canister inlet port 151. Canister inlet line 152 is further configured to selectively couple to outlet port 131 of fluid port member 103.

As shown in FIGS. 1 and 2, canister inlet line 152 includes a fluid tube 155 and fluid coupler ends 156 mounted on the end of fluid tube 155. Fluid tube 155 is configured to convey fluids, such as soiled wash and rinse water. Fluid coupler ends 156 are configured to selectively couple to fluid ports, including outlet port 131 and canister inlet port 151.

Vacuum port 153 is in fluid communication with canister interior volume 154. As shown in FIGS. 1 and 2, vacuum port 153 is configured to selectively couple to a vacuum line 157 of a vacuum 158. Activating vacuum 158 operates to pull fluid from interior 113 of sleeve 101 through outlet port 131 of fluid port member 103. The fluid pulled from interior 113 is received into canister interior volume 154 through canister inlet port 151.

Gas Supply

Gas supply 106 function to supply gas bubbles inside sleeve 101 through inlet port 130 of fluid port member 103. The gas bubbles supplied by gas supply 106 serve to agitate the user's hair while it is being washed, conditioned, and/or rinsed. Agitating the user's hair with gas bubbles has been observed to make washing, conditioning, and rinsing the hair more effective and efficient.

The gas supplied by gas supply 106 is oxygen. However, the gas supply may be configured to supply any suitable gas. Suitable gases include oxygen, nitrogen, helium, and gas mixtures, such as air.

As shown in FIGS. 1 and 2, gas supply 106 is in fluid communication with inlet port 130 of fluid port member 103.

Gas supply 106 is configured to supply gas to interior 113 of sleeve 101 through inlet port 130 of the fluid port member 103. When sleeve 101 contains a volume of liquid, the gas supplied to sleeve 101 forms bubbles that pass through the liquid upon reaching interior 113 of sleeve 101.

Vent 122 of cover 102 of may be selectively opened to allow gas bubbles in interior 113 to escape sleeve 101. The openings of vent 122 are in fluid communication with sleeve 101, which enables gas introduced into sleeve 101 by gas supply 106 to exit sleeve 101 through the openings of vent 122. Allowing gas bubbles to exit sleeve 101 through vent 122 avoids over-pressurizing sleeve 101.

In some instances, gas supply 106 is activated to supply gas to sleeve 101 concurrently with discard system 105 being activated to draw liquid out of sleeve 101 to be discarded. Supplying gas to sleeve 101 with vent 122 selectively closed may assist with purging sleeve 101 of liquid. Supplying gas to sleeve 101 may also assist with maintaining a pressure balance between the inside and outside of sleeve 101 as discard system 105 pulls a vacuum to draw the liquid out of sleeve 101 through outlet port 131.

However, discard system 105 is configured to effectively drain sleeve 101 of liquid without a concurrent supply of gas introduced via gas supply 106. Selectively opening vent 122 when drawing liquid out of sleeve 101 via the negative pressure created by discard system 105 provides a source of air to assist with purging sleeve 101. The air supplied by vent 122 being open also serves to avoid sleeve 101 crumpling against the user's head from a pressure imbalance.

In the example shown in FIG. 1, gas supply 106 is an oxygen regulator mounted to a wall. However, the gas supply may be any currently known or later developed device for supplying a suitable gas. For example, the gas supply may be a portable canister of gas.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A hair washing apparatus comprising:

a sleeve selectively disposed over a head of a user, the sleeve defining:

a top opening disposed proximate a crown of the head; and a bottom opening opposite the top opening and proximate a temple of the head;

an interior between the top opening and the bottom opening and configured to contain a volume of liquid around the head;

a cover selectively coupled to the top opening of the sleeve and disposed proximate the crown of the head;

a fluid port member in fluid communication with the interior of the sleeve and including:

an inlet port; and an outlet port; and a seal member disposed around the bottom opening of the sleeve and configured to form a liquid-tight seal between the sleeve and the head.

2. The hair washing apparatus of claim 1, further comprising a discard system selectively coupled to the fluid port member.

3. The hair washing apparatus of claim 2, wherein the discard system is configured to selectively remove liquid from the interior of the sleeve through the outlet port of the fluid port member.

4. The hair washing apparatus of claim 3, wherein:

the discard system includes:

a canister defining a canister interior volume;

a canister inlet port in fluid communication with the canister interior volume;

a canister inlet line selectively coupled to the canister inlet port and to the outlet port of the fluid port member; and a vacuum port in fluid communication with the canister interior volume and selectively coupled to a vacuum line of a vacuum;

activating the vacuum operates to pull liquid from the interior of the sleeve through the outlet port of the fluid port member into the canister interior volume through the canister inlet port.

5. The hair washing apparatus of claim 3, wherein the inlet port is configured to receive a gas into the interior of the sleeve concurrently with the discard system removing liquid from the interior of the sleeve through the outlet port.

6. The hair washing apparatus of claim 5, further comprising a gas supply in fluid communication with the inlet port of the fluid port member and configured to supply the gas to the interior of the sleeve through the inlet port of the fluid port member.

7. The hair washing apparatus of claim 1, wherein the sleeve is formed from a flexible material.

8. The hair washing apparatus of claim 7, wherein the sleeve is configured to be worked with hands to agitate the volume of liquid around the user's head to wash the hair of the user.

9. The hair washing apparatus of claim 1, wherein the sleeve includes graduation markings to indicate the volume of liquid contained in the interior of the sleeve.

10. The hair washing apparatus of claim 1, wherein the cover includes a vent configured to enable gas to exit the hair washing apparatus.

11. The hair washing apparatus of claim 10, wherein the cover is configured to selectively open and close the vent.

12. The hair washing apparatus of claim 11, wherein the cover includes a cap selectively disposed over the vent to selectively close the vent.

13. The hair washing apparatus of claim 12, wherein the cap is complementarily configured with the vent to selectively couple to the vent.

14. The hair washing apparatus of claim 13, wherein:

the vent includes a lip extending around an outer periphery of the vent;

the cap defines a cap recess complementing the lip; and the cap and the lip selectively couple via a press fit when the lip is received in the cap recess.

15. The hair washing apparatus of claim 1, wherein the cover includes:

a base rim coupled to the top opening of the sleeve; and a lid selectively removable from the base rim.

16. The hair washing apparatus of claim 15, wherein the base rim and the lid define complementary threads to enable them to threadingly couple.

17. The hair washing apparatus of claim 16, wherein the base rim and the lid form a liquid-tight seal when selectively coupled together.

18. The hair washing apparatus of claim 1, wherein the inlet port and the outlet port are disposed between the top opening of the sleeve and the seal member to avoid the seal member restricting fluid communication between the interior of the sleeve and the inlet port and the outlet port.

19. The hair washing apparatus of claim 18, wherein the inlet port and the outlet port are spaced from the seal member to define a gap between the seal member and the inlet port and the outlet port.

20. The hair washing apparatus of claim 19, where the inlet port is horizontally adjacent to the outlet port.

* * * * *